US007526094B2

(12) United States Patent
Hickling

(10) Patent No.: US 7,526,094 B2
(45) Date of Patent: Apr. 28, 2009

(54) NORMALIZATION AND CALIBRATION OF MICROPHONES IN SOUND-INTENSITY PROBES

(76) Inventor: Robert Hickling, 8306 Huntington Rd., Huntington Woods, MI (US) 48070

( * ) Notice: Subject to any disclaimer, the term of this patent is extended or adjusted under 35 U.S.C. 154(b) by 283 days.

(21) Appl. No.: 11/415,910

(22) Filed: May 2, 2006

(65) Prior Publication Data

US 2007/0223730 A1 Sep. 27, 2007

Related U.S. Application Data

(63) Continuation-in-part of application No. 10/746,763, filed on Dec. 26, 2003, now Pat. No. 7,054,228, and a continuation-in-part of application No. 10/396,541, filed on Mar. 25, 2003, now Pat. No. 7,058,184.

(51) Int. Cl.

| | |
|---|---|
| ***H04R 1/02*** | (2006.01) |
| ***H04R 29/00*** | (2006.01) |
| ***H04R 3/00*** | (2006.01) |
| ***H04R 1/20*** | (2006.01) |

(52) U.S. Cl. ..... 381/91; 381/58; 381/95; 381/338; 381/353

(58) Field of Classification Search ..... 381/92, 381/91, 58, 59, 95, 111, 112, 113, 114, 115, 381/122, 338, 353, 56; 73/646; 367/13
See application file for complete search history.

(56) References Cited

U.S. PATENT DOCUMENTS 1,356,359 A * 10/1920 Heck ..... 73/591

(Continued)

FOREIGN PATENT DOCUMENTS

FR 2864199 A1 * 12/2003

OTHER PUBLICATIONS

U.S. Appl. No. 10/396,541, filed Mar. 25, 2003, R. Hickling.

(Continued)

*Primary Examiner*—Vivian Chin
*Assistant Examiner*—Kile Blair
(74) *Attorney, Agent, or Firm*—Reising Ethington P.C.

(57) ABSTRACT

A system for normalizing and calibrating the microphones of a sound-intensity probe or a composite of such probes, with respect to a stable comparison microphone with known acoustical characteristics. Normalizing and calibrating are performed using an apparatus 57 consisting of a tube with a loudspeaker inserted in one end and a fixture for holding the microphones of the probe together with the comparison microphone in the other end. The comparison microphone has known acoustical characteristics supplied by the manufacturer. Two banks of quarter-wave resonators 83 and 84 are attached to the side of the tube to absorb standing waves. The sound-intensity probe can be either a two-microphone probe used for measuring a single component of the sound-intensity vector or a probe with four microphones in the regular tetrahedral arrangement used for measuring the full sound-intensity vector. The microphones in the probe are made to have a substantially identical response with the comparison microphone by determining the transfer functions between the microphones and the comparison microphone. The transfer functions and known acoustical characteristics of the comparison microphone are then used to correct the pressure measurements by the microphones, when they are used to measure sound intensity. This ensures that the sound-intensity measurements are accurate and that there is essentially no bias in determining the direction to a sound source from the direction of the sound-intensity vector.

16 Claims, 7 Drawing Sheets

U.S. PATENT DOCUMENTS

| | | | | | |
|---|---|---|---|---|---|
| 1,924,091 | A | * | 8/1933 | Eisenhour | 73/646 |
| 4,236,040 | A | | 11/1980 | Chung | |
| 4,421,957 | A | * | 12/1983 | Wallace, Jr. | 381/338 |
| 4,463,453 | A | * | 7/1984 | Cohen et al. | 367/135 |
| 5,125,260 | A | * | 6/1992 | Hedeen | 73/1.82 |
| 5,172,597 | A | * | 12/1992 | Hedeen | 73/646 |
| 5,363,452 | A | * | 11/1994 | Anderson | 381/91 |
| 5,567,863 | A | * | 10/1996 | Larson et al. | 73/1.82 |
| 7,068,801 | B1 | * | 6/2006 | Stinson et al. | 381/160 |

OTHER PUBLICATIONS

U.S. Appl. No. 10/746,763, filed Dec. 26, 2003, R. Hickling.

Anon, "Instruments for Measurement of Sound Intensity" Standard ANSI S1.9-1966, American National Standards Institute.

F.J. Fahy, "Sound Intensity", Second Edition, E & FN Spon, and imprint of Chapman and Hall; London, UK, 1995—Title page, Copyright Page, Contents (3 pgs.), Introduction (1 pg.

Anon, "Notes for Seminar on Sound Intensity", published by Bruel and Kjaer, Naerun, Denmark, 2005, pp. 1-36.

* cited by examiner

NORMALIZATION AND CALIBRATION OF MICROPHONES IN SOUND-INTENSITY PROBES

THIS APPLICATION IS A CONTINUATION-IN-PART OF U.S. patent application ENTITLED "ACOUSTIC MEASUREMENT METHOD AND APPARATUS" Ser. No. 10/396,541, FILED 2003, Mar. 25, now U.S. Pat. No. 7,058,184 AND OF CONTINUATION-IN PART ENTITLED "SOUND SOURCE LOCATION AND QUANTIFICATION USING VECTOR PROBES" Ser. No. 10/746,763 FILED 2003, Dec. 26, now U.S. Pat. No. 7,054,228 BY ROBERT HICKLING THE PRESENT INVENTOR.

TECHNICAL FIELD

This invention relates to a means and method for the normalization and calibration of the microphones in sound-intensity probes.

BACKGROUND OF THE INVENTION

Sound-Intensity Probes

The sound-intensity vector is the time average of sound-power flow per unit area expressed in spectral form.

The sound-intensity probe that is currently in greatest use consists of two microphones that measure a single component of the vector along a line joining the microphone centers. Usually the measurement is made in a direction perpendicular to a surface, such as a hypothetical surface enclosing a sound source or the surface of the source itself. Such probes are described in 1. Anon., 1996, "Instruments for Measurement of Sound Intensity", Standard ANSI S1.9-1996, American National Standards Institute and in
2. F. J. Fahy, 1995, "Sound Intensity", Second Edition, E& FN Spon, an imprint of Chapman and Hall, London.

Sound intensity is generally computed using a mathematical equation involving the cross spectrum of the sound pressures at two microphones. The equation is given in 3. J. Y. Chung, 1980, "Sound Intensity Meter", U.S. Pat. No. 4,236,040, November 25.

It is derived using finite-difference approximations, based on the requirement that the spacing between the microphones is less than the wavelength of sound, divided by $2\pi$. This places an upper limit on the frequency range of the measurement and the microphones must be placed sufficiently close to meet this requirement. There is also a lower limit due to possible error from phase mismatch of the microphones at lower frequencies. This problem is alleviated by placing the microphone further apart. Different microphone spacings are used in practice.

Recently a new acoustic instrument, the acoustic vector probe (AVP) was developed by 4. R. Hickling 2003, "Acoustic Measurement Method and Apparatus", patent application to the U.S. Patent and Trademark Office, Ser. No. 10/396,541, Filing Date Mar. 25, 2003.

The technical information contained in this application is hereby incorporated herein by reference. An AVP consists of a tetrahedral arrangement of four small microphones that simultaneously measures, at a point, the three fundamental quantities of acoustics, namely the sound-intensity and sound-velocity vectors, and sound pressure. The microphones are arranged in pairs pointing in opposite directions.

AVPs are more accurate, more compact and less expensive than previous instruments for measuring the sound-intensity vector.

The AVP is used principally for locating and quantifying sound sources, as described in 5. R. Hickling, 2003, "Sound Source Location and Quantification using Arrays of Vector Probes", patent application to the U.S. Patent and Trademark Office, Ser. No. 10/746,763, Filing Date Dec. 26, 2003.

The technical information contained in this continuation-in-part is hereby incorporated herein by reference.

In order for these two types of probe to measure sound intensity accurately, the microphones have to be corrected so that their response is substantially identical over the frequency range of the measurement. This is particularly important for AVPs because, to determine the direction of a sound source accurately, the probe has to be omnidirectional, i. e. with a sensitivity that has no directional bias.

Composite sound-intensity probes having a common coordinate system and measurement point can be constructed, consisting of nested arrangements of either the two-microphone probe or the AVP. These arrangements increase the frequency range of the measurement by extending measurement accuracy for higher and lower frequencies. As before, the microphones in these probes have to have a response that is substantially identical to achieve the required accuracy.

Currently microphones used for sound-intensity measurement are assumed to have a flat response over the frequency range of the measurement. The response is generally depicted on a decibel scale where deviation from flatness appears less significant. Using the flatness assumption, microphones are calibrated and phase-matched at a single frequency, typically about 250 Hz. The calibration and phase-matching are then considered to apply over the appropriate frequency range, as described in Reference 1 and in 6. Anon. 2005, "Notes for Seminar on Sound Intensity", Published by Bruel and Kjaer, Naerum, Denmark.

However on a linear scale the microphones of the sound-intensity probes can be seen to deviate from flatness. Hence calibration and phase-matching at a single frequency cannot be used to make corrections to provide a substantially identical response between microphones. The present invention includes an instrument and a transfer-function method for making such corrections over the frequency range of the measurement. The use of transfer functions is explained in detail in the description of the preferred embodiment.

SUMMARY OF THE INVENTION

The present invention includes and utilizes an apparatus and method for making the microphones of a sound-intensity probe, or of a composite of such probes, have a substantially identical response with a standard comparison microphone, by determining the transfer functions between the microphones of the probe and the comparison microphone. The purpose is to improve the accuracy of sound-intensity measurement, particularly in determining the direction of a sound source.

The apparatus includes a normalizer-calibrator tube with a loudspeaker at one end and a fixture at the other end that holds the microphones of the probe, along with the comparison microphone. The comparison microphone is stable and has known acoustical characteristics provided by the manufacturer. The microphones are all flush with the fixture's inner surface where they are simultaneously exposed to plane waves proceeding down the normalizer-calibrator tube from the speaker. In general the speaker emits pseudo-random white noise or other broadband time-invariant or stationary signals. Standing-wave sinusoids in the normalizer-calibrator tube are absorbed by quarter-wave attenuators protruding from the side of the tube. The attenuators are a series of narrow tubes with openings flush with the wall of the normalizer-calibrator tube and with the outer ends closed. The attenuators decrease in length from a maximum that is essentially half the length of the normalizer-calibrator tube down to a small minimum length, thereby absorbing standing waves from the lowest possible frequency up to high frequencies. The attenuators protrude in two banks. One protrudes to maxima at the ends of the normalizer-calibrator tube and decreases to a small minimum at the center. This absorbs the even standing-wave sinusoids. The other protrudes to a maximum length at the center of the normalizer-calibrator tube and decreases to a small minimum length at the ends. This absorbs the odd standing-wave sinusoids.

The microphones in the probes are preferably small electret microphones such as the FG series available from Knowles Electronics LLC, of Ithaca Ill. The Knowles microphones are omnidirectional and small, having outer diameters less than 2.6 mm with similar body lengths. Despite their small size they have a sensitivity of about 22 mV/Pa, which is comparable to the sensitivity of larger microphones. A standard condenser microphone with known acoustical characteristics is used as a stable comparison microphone for normalization and calibration of the microphones in the probes.

There are two types of sound-intensity probes. One is a side-by-side arrangement of two microphones that are inserted together with the comparison microphone in the fixture at the end of the normalizer-calibrator tube. The other probe is an acoustic vector probe (AVP) with four microphones in the regular tetrahedral arrangement pointing in pairs in opposite directions. The microphones of the AVP are inserted in the fixture, one pair at a time, forming a line on either side of the comparison microphone. The comparison microphone passes through the center of the probe and is located centrally in the fixture.

Each type of sound-intensity probe can be combined with the same type of probe to form a composite probe that extends the frequency range of the sound-intensity measurement. Composite probes have a common orientation and measurement point. There are two types of composite probe, one with at least two nested arrangements of side-by-side two-microphone probes and the other with least two nested arrangements of AVPs. The constituent probes are chosen to cover different parts of the acoustic frequency range. The fixture in the end of the normalizer-calibrator tube can hold at least four microphones of a composite probe, together with the comparison microphone The normalizer-calibrator system is used to determine the transfer function between each microphone of a sound-intensity probe and the comparison microphone. When measuring sound intensity, the spectral form of the sound pressure measured at each microphone in a probe is multiplied by the corresponding transfer function. This makes the microphones have substantially the same response as the comparison microphone. In this way the responses of all the microphones in the probe appear identical and the probe is essentially omnidirectional. The sound-intensity vector can then be calibrated using the known acoustical characteristics of the comparison microphone to provide accurate measurements of sound intensity.

DESCRIPTION OF THE PREFERRED EMBODIMENT

Figure 1:
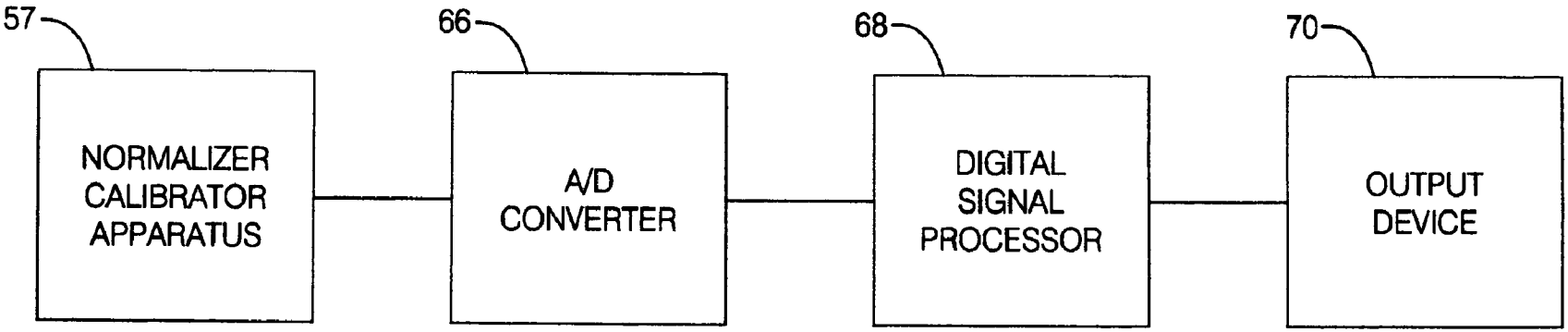
FIG. 1 is a block schematic diagram illustrating the normalizer-calibrator apparatus, A/D converter, digital signal processor and other apparatus utilized in determining the transfer functions that make the microphones of the sound-intensity probe have a substantially identical response with a comparison microphone.
Figure 2A:
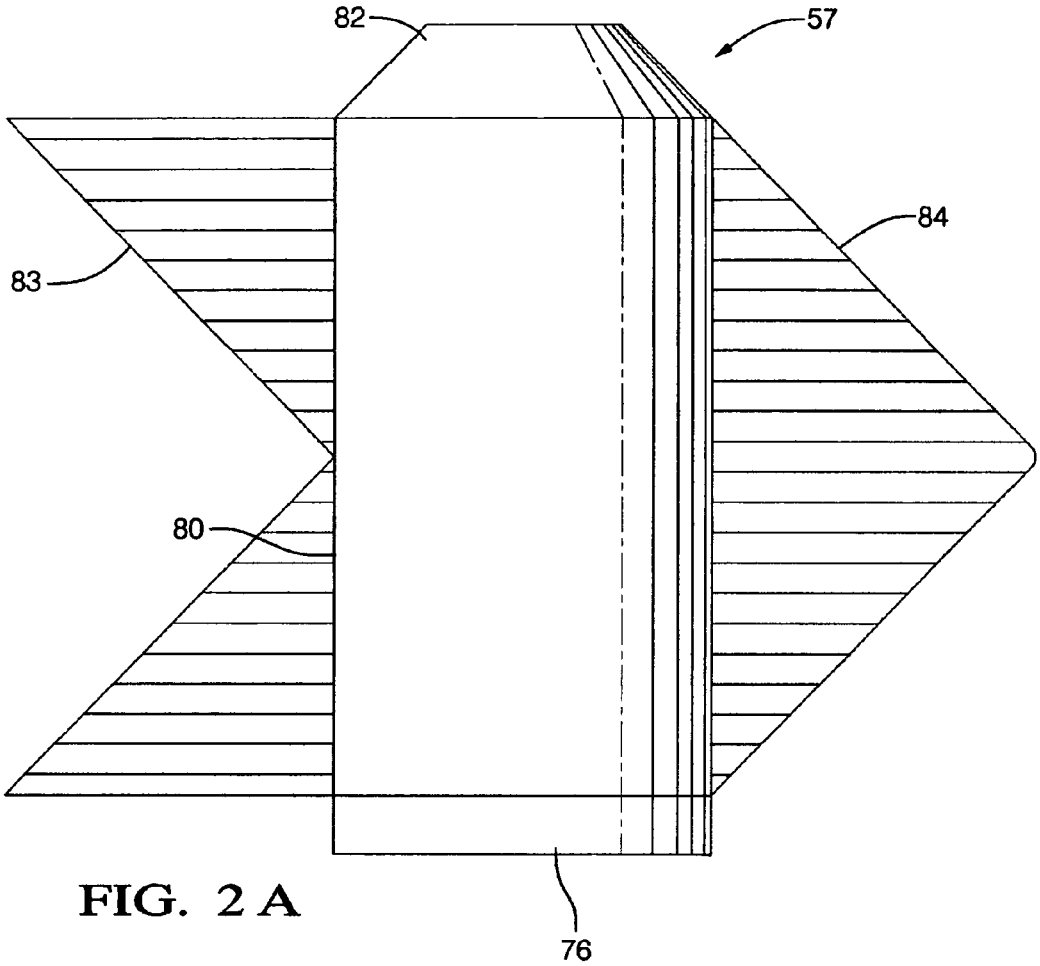
FIG. 2 shows the apparatus for normalizing and calibrating the microphones of the sound-intensity probe, including a tube with a loudspeaker at one end, and a fixture for holding the microphones of the probe together with the comparison microphone at the other end. Also shown are banks of quarter-wave attenuators set in the sides of the tube for absorbing the odd and even modes of the standing waves in the tube. In the figure (a) is the view in elevation and (b) is the end view as seen from the base.
Figure 2B:
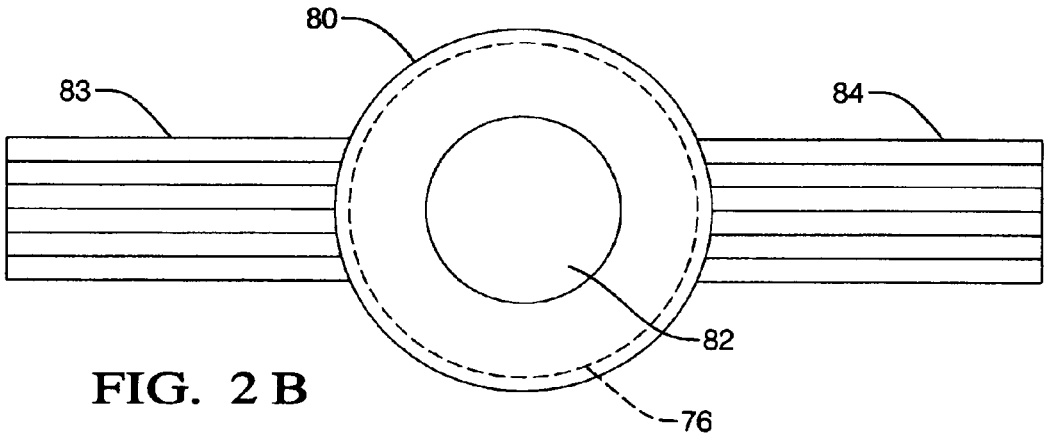
Figure 3A:
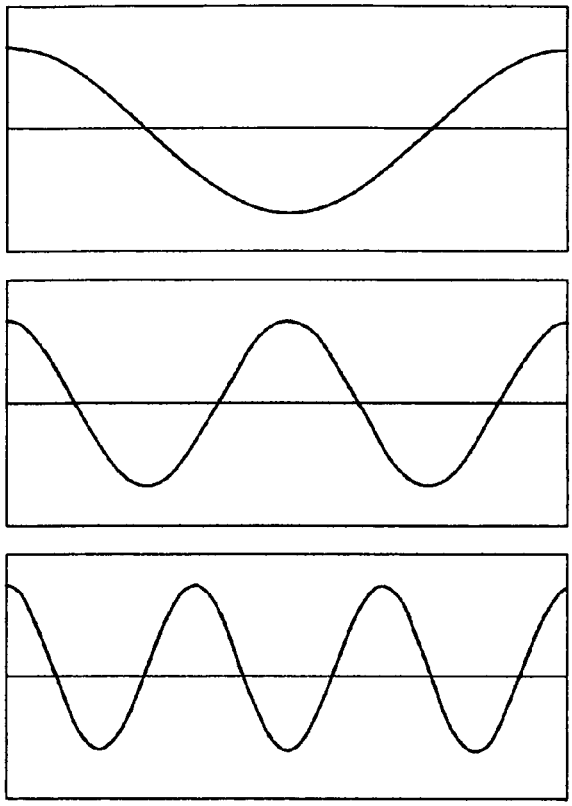
FIG. 3 shows sound-pressure traces of the first few sinusoidal modes of the standing waves along the length of the normalizer-calibrator tube, where (a) depicts even modes and (b) depicts odd modes.
Figure 3B:
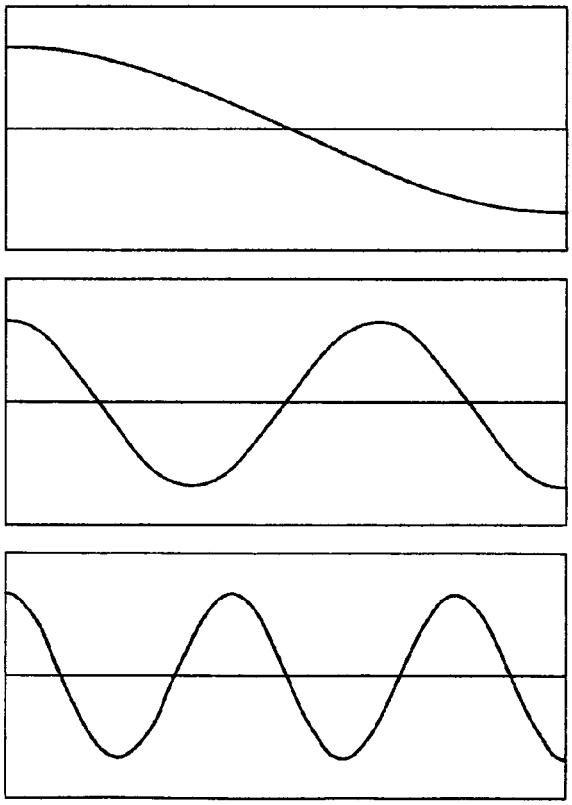

FIG. 1 shows a block diagram of the normalizer-calibrator system. Signals from the normalizer-calibrator apparatus 57 are passed through an A/D converter 66 to the digital signal processor 68 which determines the transfer functions between individual microphones of a sound-intensity probe and a comparison microphone. Results are displayed using the output device 70. FIG. 2 depicts elevation and plan views of the normalizer-calibrator apparatus 57. This consists of a tube 80 with a loudspeaker 82 at one end and a fixture 76 for holding the microphones from the sound-intensity probe and the comparison microphone at the other end. All the microphones are flush with the inner surface of the fixture where they are simultaneously exposed to plane waves proceeding down the normalizer-calibrator tube from the speaker. The speaker is controlled by the digital signal processor. In general it emits pseudo-random white noise or other broadband time-invariant or stationary signals. Standing waves in the tube are absorbed by banks of quarter-wavelength attenuator tubes 83 and 84 of varying length with closed ends, protruding from the side of the normalizer-calibrator tube with their openings flush with the inner wall of the tube. The attenuator tubes are shown perpendicular to the normalizer-calibrator tube but they can also protrude at other angles. The longest attenuator tube is approximately half the length of the normalizer-calibrator tube. The principle of a quarter-wave attenuator tube is well-known. Sound travels up the tube and is reflected back in a manner that is out of phase with the sound at the mouth of the tube. Bank 83 absorbs even modes of standing-wave sinusoids and bank 84 absorbs odd modes of standing-wave sinusoids. The first few standing-wave sound-pressure sinusoids are illustrated in FIG. 3. They keep the same zero crossing points and oscillate up and down in between. The even modes have the same maximum/minimum value with the same sign at the ends of the normalizer-calibrator tube 80 and have a maximum/minimum value at the mid point of 80. The odd modes have the same maximum/minimum value but with a different sign at the ends of 80 with a zero value at the mid point of 80. The tubes in the banks of quarter-wave attenuators in 83 and 84 have a range of lengths that cover the frequency range of the standing waves.

Figure 4:
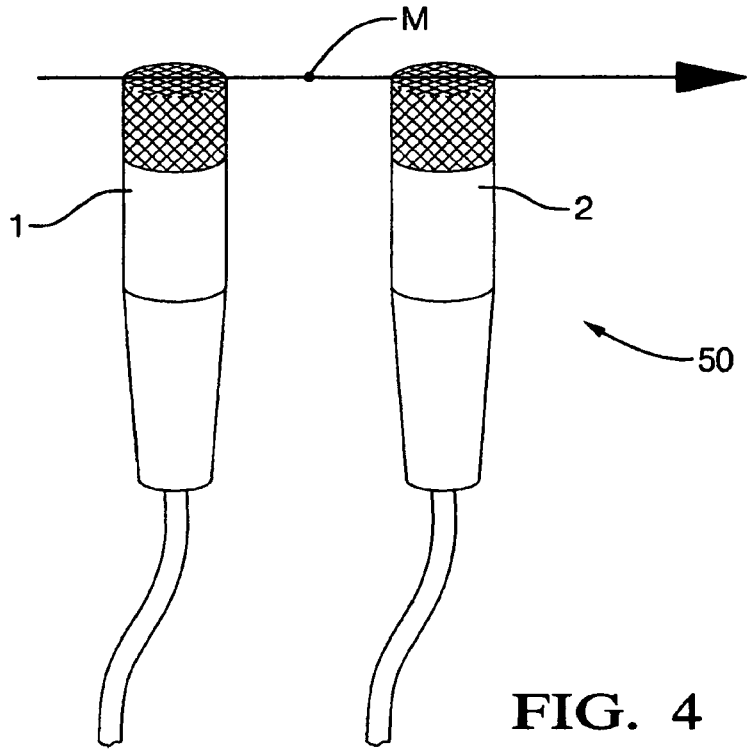
FIG. 4 is schematic view of the side-by-side arrangement of two microphones for measuring a single component of the sound-intensity vector in a direction along a line joining the centers of the two microphones as indicated by the arrow. M is the measurement point midway between the microphones.
Figure 5:
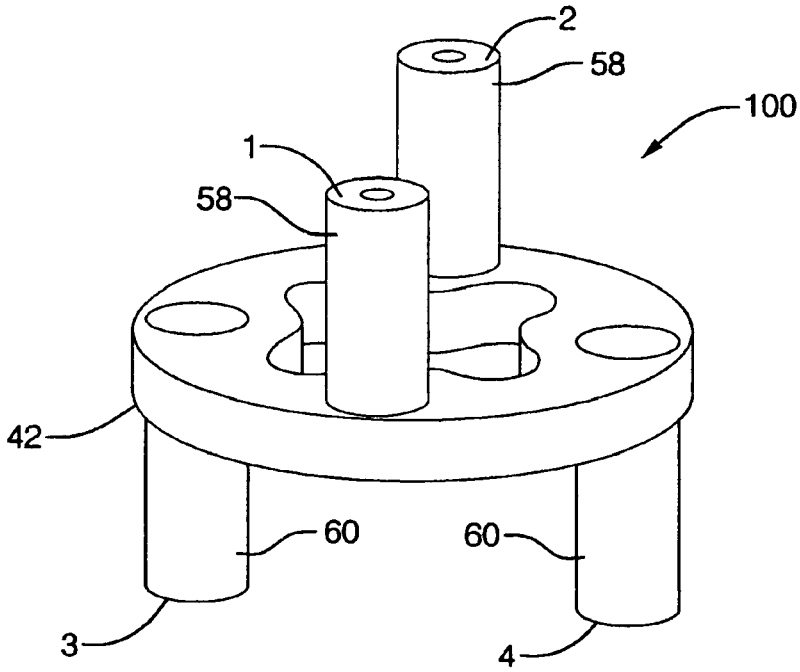
FIG. 5 is a perspective view of a probe for simultaneously measuring all the components of the sound-intensity vector, using four microphones in the regular tetrahedral arrangement pointing in pairs in opposite directions.
Figure 6A:
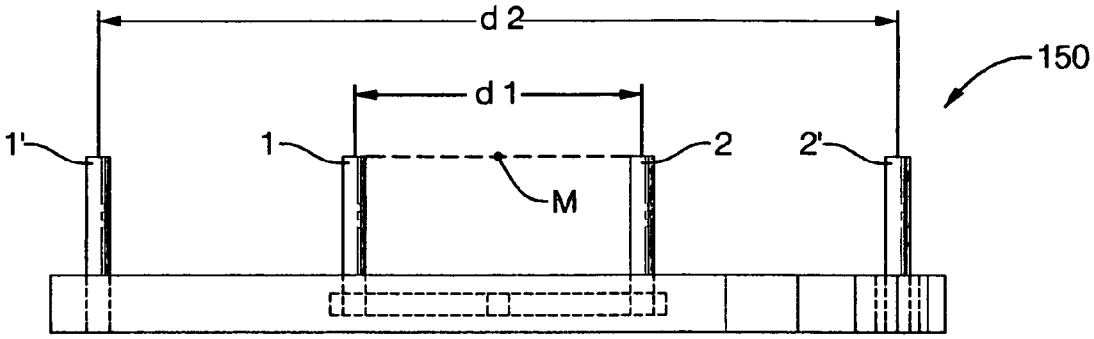
FIG. 6 is a side view of composite probes arranged as nested pairs that extend the frequency range of the measurement for (a) two-microphone probes and (b) probes with four microphones in the regular tetrahedral arrangement. The composite probes have the same coordinate system and measurement point M
Figure 6B:
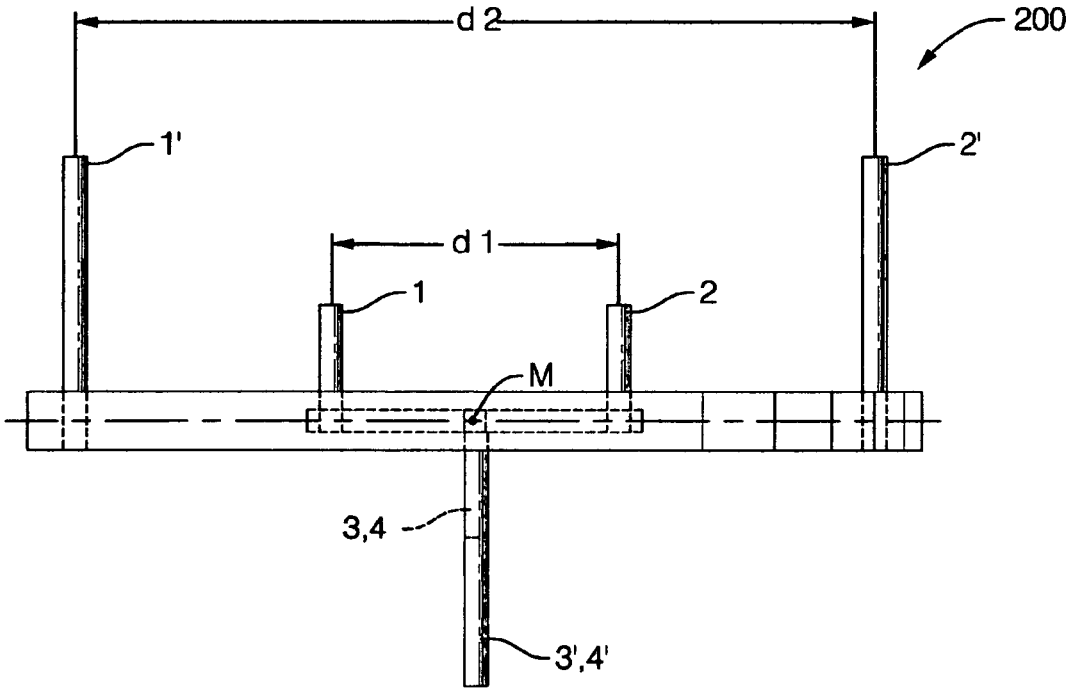
Figure 7A:
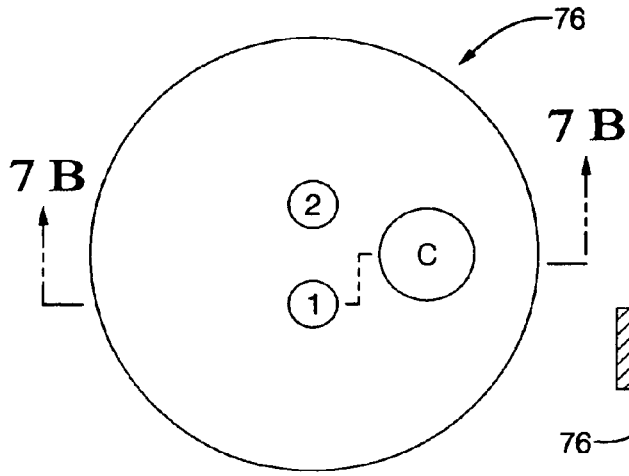
FIG. 7 shows views of the fixture for two microphones of a probe of the type shown in FIG. 4 and a comparison microphone C that is inserted into the normalizer-calibrator tube where the microphones are spaced apart from the comparison microphone, (a) plan view and (b) side view.
Figure 7B:
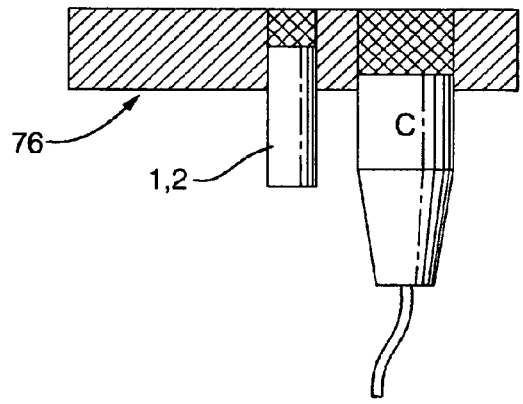
Figure 8A:
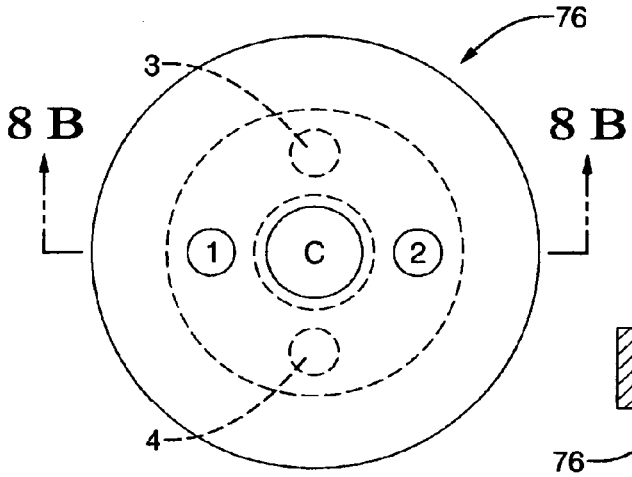
FIG. 8 shows views of the fixture for two microphones of the acoustic vector probe of the type shown in FIG. 5 and a comparison microphone C positioned for inserting into the normalizer-calibrator tube with the microphones positioned in a line on either side of the comparison microphone, (a) plan view and (b) side view. The microphones are inserted one pair at a time, first microphones 1 and 2 and then microphones 3 and 4.
Figure 8B:
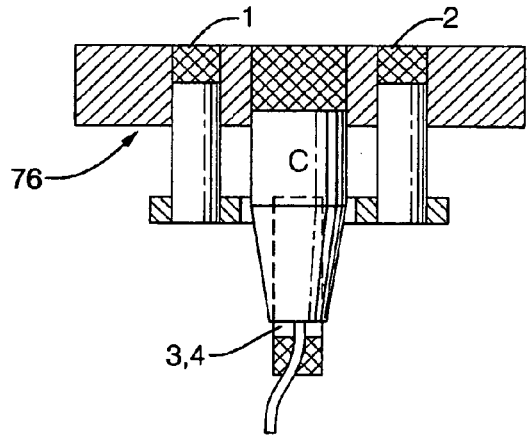

FIGS. 4 and 5 show the two types of sound-intensity probe, whose microphones are normalized and calibrated using the apparatus in FIG. 2. FIG. 4 shows probe 50 with a side-by-side arrangement of microphones 1 and 2. This measures a single component of the sound-intensity vector along a line joining the midpoints of the microphones, as indicated by the arrow. The measurement is the point M midway between the microphones. FIG. 5 shows a perspective view of probe 100 that simultaneously measures all three components of the sound-intensity vector. This has four microphones 1, 2, 3 and 4 located at the vertices of a regular tetrahedron. Microphones 1 and 2 are supported by posts 58. Microphones 3 and 4 are supported by posts 60 and point in the opposite direction to microphones 1 and 2. Posts 58 and 60 are attached to a ring 42. FIGS. 6(*a*) and (*b*) show composite probes 150 and 200 with nested arrangements corresponding respectively to the probes 50 and 100 in FIGS. 4 and 5. The purpose of the composite probes is to extend the frequency range of the sound-intensity measurement. The inner probe covers higher frequencies and the outer probe covers lower frequencies. Composite probes have a common orientation and measurement point M FIGS. 7(*a*) and (*b*) show plan and elevation views of how the microphones of probe 50 can be inserted into the fixture 76 in relation to the comparison microphone C. FIGS. 8(*a*) and (*b*) show plan and elevation views of how the microphones 1 and 2 of probe 100 are inserted into the fixture 76 in a line with the comparison microphone C. Such an arrangement is necessary because the preamplifier of the comparison microphone C generally has to pass through the center of the ring 40 of the probe 100, as shown in FIG. 8(*b*). The microphones of 100 are inserted one pair at a time. Microphones 1 and 2 can be inserted first. Then microphones 3 and 4 are inserted after first reversing the probe and rotating through ninety degrees.

Figure 9A:
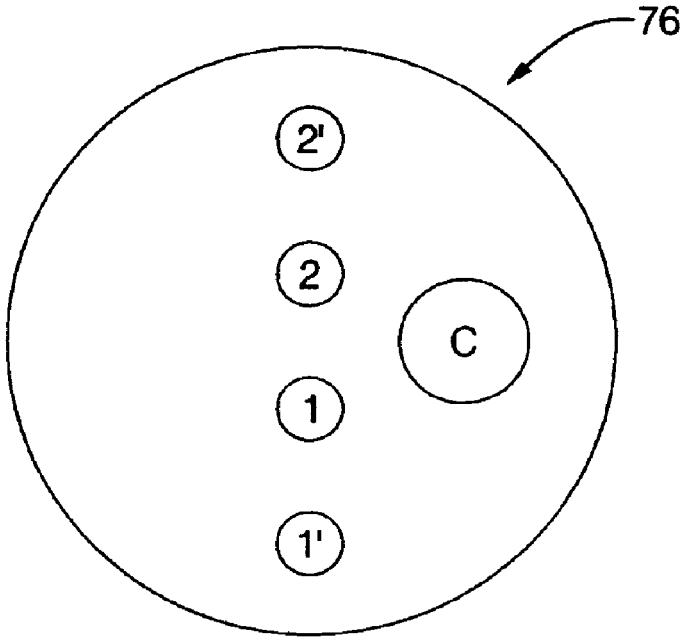
FIG. 9 shows plan views of two types of fixtures for holding the four microphones of the composite probes shown in FIG. 6 together with a comparison microphone C, for inserting into the normalizer-calibrator tube, (a) where the microphones are spaced apart from the comparison microphone and (b) where the microphones are positioned in a line on either side of the comparison microphone.
Figure 9B:
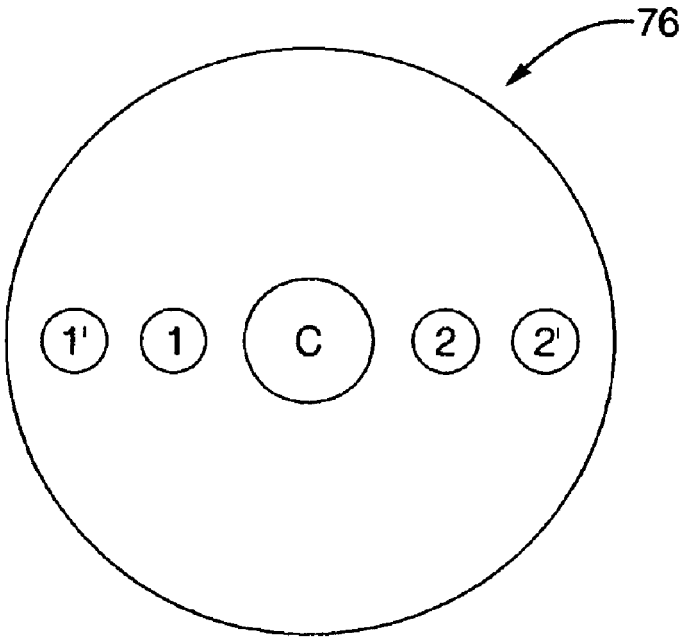

FIGS. 9 (*a*) and (*b*) show plan views of similar positionings in the fixture 76 for the microphones of the composite probes 150 and 200. The microphones of the composite probe 150 can all be normalized and calibrated at the same time. Because of the different lengths of the supporting tubes of the composite probe 200, the outer microphones 1' and 2' have to be normalized and calibrated separately from the inner microphones 1 and 2 with special plugs to fill the empty inner holes. The outer microphones fill the outer holes when the inner microphones are being normalized and calibrated.

The use of transfer functions in the normalization and calibration procedure can be described mathematically as follows. Standard DFT (digital Fourier transform) techniques are performed in the microprocessor to determine the transfer function H1C(f) between microphone 1 (for example) and the comparison microphone C, as follows $$H1C(f)=G1C(f)/G11(f) \tag{1}$$

where G1C(f) is the cross-spectrum between the signal at microphone 1 and the calibration microphone C, given by $$G1C(f)=FpC(f)\cdot Fp1(f)^* \tag{2}$$

and G11(f) is the auto-spectrum of the signal at microphone 1 given by $$G11(f)=Fp1(f)\cdot Fp1(f)^* \tag{3}$$

where the asterisks denote the complex conjugate. To make the signal Fp1(f) at microphone 1 look like the signal FpC(f) at the calibration microphone C, it is multiplied by the transfer function in Equation (1) to give $$Fp1C(f)=Fp1(f)\cdot H1C(f) \tag{4}$$

The process is repeated for microphone 2 using relations corresponding to Equations (1) through (4) with 2 substituted for 1, as follows $$H2C(f)=G2C(f)/G22(f) \tag{5}$$

where $$G2C(f)=FpC(f)\cdot Fp2(f)^* \tag{6}$$

and $$G22(f)=Fp2(f)\cdot Fp2(f)^* \tag{7}$$

To make Fp2(f) look like FpC(f), Fp2(f) is multiplied by the transfer function in Equation (5) to give $$Fp2C(f)=Fp2(f)\cdot H2C(f) \tag{8}$$

For the four-microphone AVP, transfer functions for microphones 3 and 4 are obtained in the same way by reversing the vector probe and rotating through ninety degrees so that the tubes 60 are inserted into the fixture 76 placing microphones 3 and 4 in the same plane and in line with the comparison microphone C. In this way all four microphones in the probe can be made to look like the comparison microphone C, making the sensitivity of the probe omnidirectional and calibrating the individual microphones using the known acoustical characteristics of the comparison microphone. Similar procedures can be used for the microphones of the composite probes 150 and 200. The transfer functions are stored in the signal processor for later use in measurements with the probes. Calibrations based on the known acoustical characteristics of the comparison microphone are applied in the digital signal processor for accuracy in the measurements.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. An acoustic measurement apparatus for making the microphones of a sound-intensity probe, or of a composite of said probes, have a substantially identical response with a comparison microphone, by determining transfer functions between said microphones and said comparison microphone, including:

a normalizer-calibrator tube with a loudspeaker mounted, centered in and closing one axial end of said normalizer-calibration tube;

a fixture for holding microphones, mountable in and closing the other axial end of said normalizer-calibrator tube where said microphones are flush with the axial inner surface of said fixture, both microphones in a side by side arrangement facing said loud speaker and simultaneously exposed to plane waves proceeding down said normalizer-calibrator tube from said loudspeaker;

said loudspeaker and said microphones connected to an analog-digital converter for conversion of analog signals to digital form and vice-versa;

said converter connected to a digital signal processor programmed to normalize and calibrate the signals by determining said transfer functions; and said processor connected to an output device for outputting the results of the computations.

2. An acoustic measurement apparatus as defined in claim 1 further comprising:

two banks of quarter-wave attenuators protruding from the side of said normalizer-calibrator tube that absorb standing-wave sinusoids in said normalizer-calibrator tube generated by said loudspeaker, said two banks of quarter-wave attenuators comprising;

a series of narrow tubes with openings flush with a tubular wall of said normalizer-calibrator tube and with outer ends closed, so that sound that is out of phase with said standing-wave sinusoids is reflected back to said normalizer-calibrator tube.

3. An acoustic measurement apparatus as defined in claim 2 wherein said series of narrow tubes decrease from a maximum length that is substantially half the length of said normalizer-calibrator tube down to a small minimum, thereby absorbing said standing-wave sinusoids from the lowest to high frequencies.

4. An acoustic measurement apparatus as defined in claim 2 wherein one of said banks of quarter-wave attenuators has maximum lengths of said narrow tubes at the ends, and a minimum length at the middle of said normalizer-calibrator tube to absorb the even modes of said standing-wave sinusoids.

5. An acoustic measurement apparatus as defined in claim 2 wherein the other of said banks of quarter-wave attenuators has a maximum length of said narrow tubes at said middle and minimum lengths at said ends of said normalizer-calibrator tube to absorb the odd modes of said standing-wave sinusoids.

6. An acoustic measurement apparatus in claim 1 wherein said microphones of said sound-intensity probes are small microphones with high sensitivity, and said comparison microphone is a stable microphone with known acoustical characteristics.

7. An acoustic measurement apparatus as defined in claim 1 wherein said two microphones of said sound-intensity probe can be inserted into said fixture at the end of said normalizer-calibrator tube, together with said comparison microphone.

8. An acoustic measurement apparatus as defined in claim 1 wherein said sound-intensity probes can be a precisely constructed acoustic vector probe comprising:

a space frame supporting four substantially identical microphones, at the vertices of an imaginary regular tetrahedron, each microphone spaced the same distance d from the other microphones, two of the microphones lying in a plane separated by a distance $d/\sqrt{2}$ from a parallel plane containing the other two microphones pointing in a reverse direction and defining a set of Cartesian axes formed by lines joining the midpoints of opposite edges of the tetrahedron whose center is the measurement point of the probe, the space frame including a supporting member lying midway between the said planes and having spaced openings with microphone support means extending from the openings.

9. An acoustic measurement apparatus as defined in claim 8 wherein said two pairs of microphones of said acoustic vector probe are inserted, one pair at a time, into said fixture at said end of said normalizer-calibrator tube, together with said comparison microphone aligned centrally with respect to said fixture and said supporting frame of said acoustic vector probe.

10. An acoustic measurement apparatus as defined in claim 9 wherein the second of said pair of microphones is inserted into said fixture at said end of said normalizer-calibrator tube by first withdrawing the first pair and turning over and rotating said acoustic vector probe through ninety degrees.

11. An acoustic measurement apparatus as defined in claim 1 wherein said composite of said probes comprises:

a line of two or more pairs of said microphones in said side-by-side arrangement with a common measurement point and orientation so that one pair is positioned either inside or outside another pair and adapted to cover various portions of the frequency range of the sound-intensity measurement.

12. A method using a system structured as in claim 1 for normalization and calibration of two substantially identical microphones in said sound-intensity probe in said side-by-side arrangement, said method including:

accurately determining the acoustical characteristics of said comparison microphone from data supplied by manufacturer and storing in said digital signal processor;

inserting said side-by-side arrangement of two microphones into said fixture for holding microphones, together with said comparison microphone, so that all the microphones are flush with the inner surface of said fixture;

inserting said fixture into said other axial end of said normalizer-calibrator tube;

generating sound waves in said normalizer-calibrator tube with said loudspeaker using said analog-digital converter and said digital signal processor;

determining said transfer functions between the said microphones in said sound-intensity probe and said comparison microphone using said analog-digital converter and said digital signal processor;

storing said transfer functions in the memory of said digital processor for normalization of said microphones in said sound-intensity probe; and calibrating said microphones in said sound-intensity probe using said digital signal processor, using said transfer functions and said acoustical characteristics of said comparison microphone, for accurate measurement of sound intensity.

13. A method using a system structured as in claim 8 for normalization and calibration of the microphones in said precisely constructed acoustic vector probe with two pairs of microphones pointing in opposite directions, said method including:

accurately determining acoustical characteristics of said comparison microphone from data supplied by manufacturer and storing in said digital signal processor;

inserting first of said pairs of microphone of said acoustic vector probe into said fixture for holding microphones, together with said comparison microphone, so that the first of said pairs of microphones and said compression microphone are flush with the inner surface of said fixture, said comparison microphone aligned centrally with respect to said fixture and said supporting frame of said acoustic vector probe;

inserting said fixture into said other axial end of said normalizer-calibrator tube;

generating sound waves in said normalizer-calibrator tube with said loudspeaker using said analog-digital converter and said digital signal processor;

determining said transfer functions between the said first pair of said microphones in said acoustic vector probe and said comparison microphone using said analog-digital converter and said digital signal processor;

storing said transfer functions in a memory of said digital processor;

normalizing and calibrating said first pair of microphones in said sound-intensity probe in said digital signal processor, using said transfer functions and said acoustical characteristics of said comparison microphone;

inserting second of said pairs of microphones of said acoustic vector probe that point in the reverse direction to said first pair into said fixture at said end of said normalizer-calibrator tube by first withdrawing said first pair and turning over and rotating said acoustic vector probe through ninety degrees;

inserting said fixture into said end of said normalizer-calibrator tube;

generating sound waves in said normalizer-calibrator tube with said loudspeaker using said analog-digital converter and said digital signal processor;

determining said transfer functions between the said second pair of said microphones in said acoustic vector probe and said comparison microphone using said analog-digital converter and said digital signal processor;

storing said transfer functions in the memory of said digital processor;

normalizing and calibrating said microphones in said sound-intensity probe using said digital signal processor, using said transfer functions and said acoustical characteristics of said comparison microphone for accurate measurement of sound intensity;

using said transfer functions to multiply the corresponding spectral form of the sound pressures measured at said microphones in said vector sound-intensity probe to make said microphones have a substantially identical response with said comparison microphone, thus making said acoustic vector probe essentially omnidirectional for accurate determination of the direction of sound sources.

14. An acoustic measurement apparatus as defined in claim 8 wherein said composite of said probes further comprises:

a nested arrangement of said acoustic vector probes including at least one additional said acoustic vector probe of a different size having said common orientation and measurement point and adapted to cover said various portions of the frequency range of said sound-intensity measurement.

15. A normalizer-calibration tube for an acoustic measurement apparatus, said tube comprising:

a first axial end for mounting a loud speaker thereto and a second axial end for mounting microphones thereto;

said normalizer-calibrator tube having at least one bank of quarter-wave attenuators protruding from a side thereof that absorb standing wave sinusoids;

said at least one bank of quarter-wave attenuators having a series of narrow tubes with openings flush with a tubular wall of said normalizer-calibrator tube and with outer ends closed so that sound that is out of phase with said standing wave sinusoids is reflected back to said normalizer-calibrator tube;

said at least one bank of quarter-wave attenuators being a first and second bank;

said first bank protruding to a maximum length at the axial ends of the normalizer-calibration tube decreased to a minimum length at an axial center for absorbing even standing wave sinusoid; and said second bank protruding to a maximum length at the axial center of the normalizer-calibration tube and decreases to a minimum length at the axial ends of the normalizer-calibration tube for absorbing odd standing wave sinusoids.

16. A normalizer-calibration tube for an acoustic measurement apparatus, said tube comprising:

a first axial end for mounting a loud speaker thereto and a second axial end for mounting microphones thereto;

said normalizer-calibrator tube having at least one bank of quarter-wave attenuators protruding from a side thereof that absorb standing wave sinusoids;

said at least one bank of quarter-wave attenuators being a first and second bank;

said first bank protruding to a maximum length at the axial ends of the normalizer-calibration tube decreased to a minimum length at an axial center for absorbing even standing wave sinusoids; and said second bank protruding to a maximum length at the axial center of the normalizer-calibration tube and decreases to a minimum length at the axial ends of the normalizer-calibration tube for absorbing odd standing wave sinusoids.

* * * * *